US011233320B2

(12) United States Patent
Lu et al.

(10) Patent No.: US 11,233,320 B2
(45) Date of Patent: Jan. 25, 2022

(54) ANTENNA STRUCTURE AND COMMUNICATION DEVICE

(71) Applicant: BOE TECHNOLOGY GROUP CO., LTD., Beijing (CN)

(72) Inventors: Yongchun Lu, Beijing (CN); Xinyin Wu, Beijing (CN); Pan Li, Beijing (CN); Jian Xu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 825 days.

(21) Appl. No.: 16/064,933

(22) PCT Filed: Nov. 9, 2017

(86) PCT No.: PCT/CN2017/110179
§ 371 (c)(1),
(2) Date: Jun. 21, 2018

(87) PCT Pub. No.: WO2018/184389
PCT Pub. Date: Oct. 11, 2018

(65) Prior Publication Data

US 2021/0210843 A1 Jul. 8, 2021

(30) Foreign Application Priority Data

Apr. 6, 2017 (CN) ..... 201720354918.5

(51) Int. Cl.
*H01Q 1/38* (2006.01)
*H01Q 1/22* (2006.01)
*H01Q 3/44* (2006.01)

(52) U.S. Cl.
CPC ..... *H01Q 1/38* (2013.01); *H01Q 1/2283* (2013.01); *H01Q 3/44* (2013.01)

(58) Field of Classification Search
CPC ..... H01Q 1/38; H01Q 1/2283; H01Q 3/44
See application file for complete search history.

(56) References Cited

U.S. PATENT DOCUMENTS 5,623,280 A 4/1997 Akins et al.
6,404,389 B1 * 6/2002 Franey ..... H01Q 9/0407 343/700 MS (Continued)

FOREIGN PATENT DOCUMENTS

CN 1383344 A 12/2002
CN 203689479 U 7/2014

(Continued)

OTHER PUBLICATIONS

Jang, et al. "Stability-Enhanced Pixel Isolation Method For Flexible Liquid Crystal Displays", Japanese Journal of Applied Physics, vol. 44, No. 9A, pp. 6670-6673; Published Sep. 8, 2005.

(Continued)

*Primary Examiner* — Seung H Lee

(57) ABSTRACT

An antenna structure and a communication device are provided. The antenna structure includes a first base substrate, a second base substrate, a dielectric layer disposed between the first base substrate and the second base substrate, and a plurality of first electrodes disposed on a side of the first base substrate close to the dielectric layer and being spaced apart from another. The antenna structure further includes at least one first buffer block disposed between the first electrodes and the first base substrate, the first buffer block is at least partially and directly contacted with the first electrodes.

19 Claims, 3 Drawing Sheets

(56) References Cited

U.S. PATENT DOCUMENTS

| | | | | |
|---|---|---|---|---|
| 7,632,740 | B2 | 12/2009 | Aoki et al. | |
| 8,474,726 | B2 * | 7/2013 | Finn | H01Q 1/2225 235/492 |
| 8,608,084 | B2 * | 12/2013 | Klaas | G06K 19/07345 235/492 |
| 10,637,133 | B2 * | 4/2020 | Lu | H01Q 1/36 |
| 2002/0167446 | A1 | 11/2002 | Goto et al. | |
| 2008/0252545 | A1 * | 10/2008 | Parsche | H01Q 19/106 343/836 |
| 2016/0241217 | A1 | 8/2016 | Sazegar et al. | |
| 2017/0093019 | A1 | 3/2017 | Toh et al. | |
| 2018/0294556 | A1 | 10/2018 | Lu et al. | |
| 2018/0294562 | A1 | 10/2018 | Lu et al. | |

FOREIGN PATENT DOCUMENTS

| | | | |
|---|---|---|---|
| CN | 106953156 | A | 7/2017 |
| CN | 206602182 | U | 10/2017 |
| TW | 201205154 | A | 2/2012 |

OTHER PUBLICATIONS

The Extended European Search Report dated Nov. 16, 2020; Appln. No. 17882256.5.

Yang Yuanyuan; "Antennas for Smart Watches", A Dissertation Submitted for the Degree of Master, South China University of Technology Guangzhou, China. 85 pages, 2014, English abstract provided.

International Search Report and Written Opinion dated Jan. 31, 2018; PCT/CN2017/110179.

* cited by examiner

ANTENNA STRUCTURE AND COMMUNICATION DEVICE

The present application claims priority of China Patent application No. 201720354918.5 filed on Apr. 6, 2017, the content of which is incorporated in its entirety as portion of the present application by reference herein.

TECHNICAL FIELD

Embodiments of the present disclosure relate to an antenna structure and a communication device.

BACKGROUND

With continuous development of the communication technology, an antenna has gradually developed toward a technology direction of miniaturization, wide-band, multi-band, and high-gain. Compared with a traditional horn antenna, a spiral antenna, and an array antenna, a liquid crystal antenna is an antenna that is more suitable for a current technology development direction.

Generally, a liquid crystal antenna includes an emission patch, a ground electrode, and liquid crystals disposed between the emission patch and the ground electrode. When a specific frequency electromagnetic wave flows into the liquid crystal antenna, upon the specific frequency coinciding with the resonant frequency of the liquid crystal antenna, the electromagnetic wave with the specific frequency can radiate outward through the liquid crystal antenna, and upon the specific frequency being not coincident with the resonant frequency of the liquid crystal antenna, the electromagnetic wave with the specific frequency cannot radiate outward through the liquid crystal antenna. And because a change in orientation of the liquid crystals may cause a different effective dielectric constant, resulting in a change in capacitance, an orientation of the liquid crystals between the emission patch and the ground electrode can be adjusted by the voltage applied to the emission patch, so as to adjust the resonant frequency of the liquid crystals can be adjusted.

SUMMARY

At least one embodiment of the present embodiment provides an antenna structure and a communication device. The antenna structure is suitable for a flexible electronic device such as a wearable smart device through at least one first buffer block disposed between the first electrode and the first base substrate.

At least one embodiment of the present embodiment provides an antenna structure, which includes: a first base substrate; a second base substrate; a dielectric layer, disposed between the first base substrate and the second base substrate; a plurality of first electrodes, disposed on a side of the first base substrate close to the dielectric layer and being spaced apart with each other; and at least one first buffer block, disposed between the first electrodes and the first base substrate, the first buffer block is at least partially and directly contacted with the first electrodes.

For example, in the antenna structure provided by an embodiment of the present disclosure, the antenna structure further includes a plurality of second electrodes, disposed on a side of the second base substrate close to the dielectric layer.

For example, in the antenna structure provided by an embodiment of the present disclosure, the antenna structure further includes at least one second buffer block, disposed between the second electrodes and the second base substrate, the second buffer block is at least partially and directly contacted with the second electrodes.

For example, in the antenna structure provided by an embodiment of the present disclosure, the first electrode and/or the second electrodes comprise at least one curved electrode.

For example, in the antenna structure provided by an embodiment of the present disclosure, each of the first electrodes is provided with at least one first buffer block disposed between the each of the first electrodes and the first base substrate, and each of the second electrodes is provided with at least one second buffer block disposed between the each of the second electrodes and the second base substrate.

For example, in the antenna structure provided by an embodiment of the present disclosure, each of the first electrodes is provided with a plurality of first buffer blocks which are spaced apart and disposed between the each of the first electrodes and the first base substrate, and each of the second electrodes is provided with a plurality of second buffer blocks which are spaced apart and disposed between the each of the second electrodes and the second base substrate.

For example, in the antenna structure provided by an embodiment of the present disclosure, a cross-sectional shape of the first buffer block and/or the second buffer block comprises at least one selected from a group consisting of a rectangular shape, a semicircular shape and a trapezoidal shape.

For example, in the antenna structure provided by an embodiment of the present disclosure, the dielectric layer includes liquid crystals.

For example, in the antenna structure provided by an embodiment of the present disclosure, the antenna structure further includes: a retaining wall, wherein the retaining wall is disposed on a side of the second base substrate close to the first base substrate, and extending towards the first base substrate, and located in an area between adjacent ones of the first electrodes; or the retaining wall is disposed on a side of the first base substrate close to the second base substrate, and extending towards the second base substrate, and located in an area between adjacent ones of the second electrodes.

For example, in the antenna structure provided by an embodiment of the present disclosure, the first buffer block and the retaining wall include a same material.

For example, in the antenna structure provided by an embodiment of the present disclosure, viscosity of a material of the first buffer block is greater than that of the first base substrate, and viscosity of a material of the second buffer block is greater than that of the second base substrate.

For example, in the antenna structure provided by an embodiment of the present disclosure, elasticity modulus of a material of the first buffer block is less than that of the first base substrate, and elasticity modulus of a material of the second buffer block is less than that of the second base substrate.

For example, in the antenna structure provided by an embodiment of the present disclosure, viscosity of a material of the first buffer block and/or viscosity of a material of the second buffer block are greater than 1000 Pas.

For example, in the antenna structure provided by an embodiment of the present disclosure, a material of the first buffer block and/or a material of the second buffer block comprise poly-dimethylsiloxane.

For example, in the antenna structure provided by an embodiment of the present disclosure, the antenna structure further includes: a first control electrode, disposed between the first base substrate and the first buffer block, and electrically connected with the first electrode; and a second control electrode, disposed between the second base substrate and the second buffer block, and electrically connected with the second electrodes.

For example, in the antenna structure provided by an embodiment of the present disclosure, orthogonal projections of the first electrode and the second electrodes on the first base substrate are disposed alternately.

For example, in the antenna structure provided by an embodiment of the present disclosure, the orthogonal projections of the first electrode and the second electrodes on the first base substrate are at least partially overlapped and alternately disposed.

At least one embodiment of the present disclosure provides a communication device, which includes the antenna structure according to any one of the abovementioned embodiments.

For example, in the communication device provided by an embodiment of the present disclosure, the communication device further includes a signal circuit and a control unit, the signal circuit is electrically connected with the antenna structure, the control unit is electrically connected with the signal circuit.

BRIEF DESCRIPTION OF THE DRAWINGS

In order to clearly illustrate the technical solution of embodiments of the present disclosure, the drawings of the embodiments will be briefly described in the following, it is obvious that the drawings in the description are only related to some embodiments of the present disclosure and not limited to the present disclosure.

DETAILED DESCRIPTION

Figure 1:
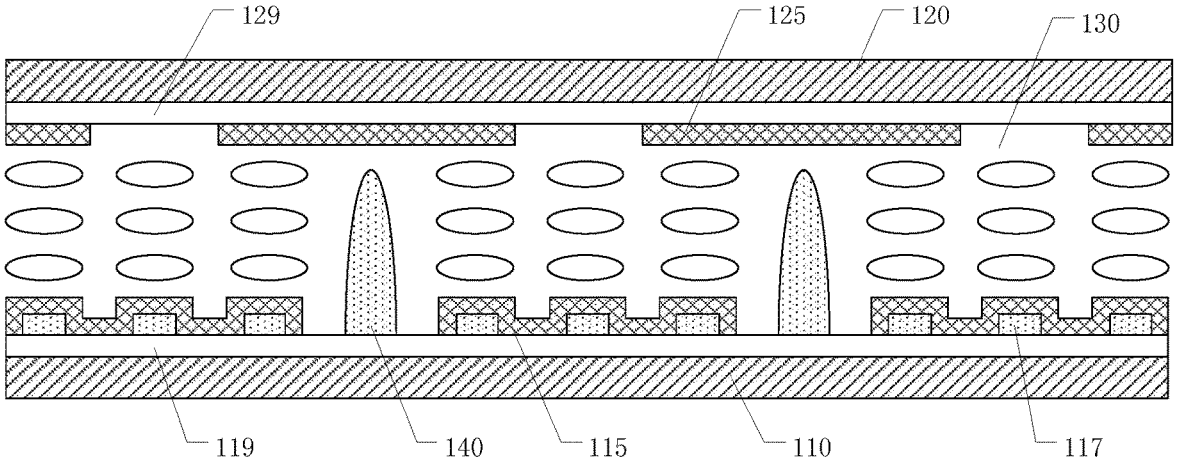
FIG. 1 is a sectional view of an antenna structure provided by an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "include," "including," "comprise," "comprising," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly.

In study, the inventor(s) of the present application notices that: with the continuous development of a communication technology and a communication device, consumers have high demand for wearable smart products with powerful functions such as fitness index monitoring, GPS, 4G, or 5G mobile networks. However, wearable smart products will inevitably curve or bend during actual use; therefore, the antennas in wearable smart products also need to have certain flexibility. In a general antenna structure, elements for signal transmission are basically metal electrodes or metal electrode wires, upon the antenna being curved or bent by external force, for example, in a case that the antenna is wound to form a cylinder or bent in a non-planar shape, a part of metal electrodes or metal electrode wires can be broken or fall off from a substrate bearing the metal electrodes or metal electrode lines, thereby causing various problems in a signal of the antenna structure.

At least one embodiment of the present disclosure provides an antenna structure and a manufacturing method thereof, and a communication device. The antenna structure includes a first base substrate, a second base substrate, a dielectric layer disposed between the first base substrate and the second base substrate, and a plurality of first electrodes disposed on a side of the first base substrate close to the dielectric layer and being spaced apart from one another. The antenna structure further includes at least one first buffer block disposed between the first electrodes and the first base substrate, the first buffer block is at least partially and directly contacted with the first electrodes. Therefore, upon the antenna structure being curved or bent, the antenna structure can prevent the first electrodes from breaking or falling off from the first base substrate by at least one first buffer block disposed between the first electrodes and the first substrate, so that the antenna structure can be suitable for a flexible electronic device such as a wearable smart device and so on. And, because of the at least one first buffer block disposed between the first electrodes and the first base substrate, a relative position of the first electrodes and the first base substrate does not change due to a breakage or abscission problem, and a regulation precision can also be improved upon the first electrodes controlling the dielectric layer, so as to improve an accuracy of the antenna structure.

Hereafter, the antenna structure and the communication device provided by the embodiments of the present disclosure will be described in detail with reference to the accompanying drawings.

An embodiment of the present disclosure provides an antenna structure. FIG. 1 illustrates a sectional view of an antenna structure according to the present embodiment. As illustrated in FIG. 1, the antenna structure includes a first base substrate 110, a second base substrate 120, a dielectric layer 130 disposed between the first base substrate 110 and the second base substrate 120, and a plurality of first electrodes 115 spaced apart on a side of the first base substrate 110 close to the dielectric layer 130. The antenna structure further includes at least one first buffer block 117 disposed between the first electrodes 115 and the first base substrate 110, the first buffer block 117 is at least partially and directly contacted with the first electrodes 115. For example, as illustrated in FIG. 1, at least one first buffer block 117 is disposed between the first electrodes 115 and the first base substrate 110, the first buffer block 117 is at least partially and directly contacted with the first electrodes 115. At this moment, the first electrodes 115 can be curved along with a shape of the first buffer block 117 to form curved electrodes. It should be noted that, the plurality of first electrodes can be applied the same electrical signal, and can also be applied different electrical signals; a plurality of second electrodes can be applied the same electrical signal, and can also be applied different electrical signals, embodiments of the present disclosure include but are not limited thereto.

In the antenna structure provided by the present embodiment, compared to a case of directly disposing the first electrodes on the first base substrate, in one aspect, at least one first buffer block disposed between the first electrodes and the first base substrate can increase a contact area between the first electrodes and the first buffer block, and a contact area between the first electrodes and the first base substrate, so as to increase a bonding force between the first electrodes and the first buffer block, and a bonding force between the first electrodes and the first base substrate, and an acting force between the first electrodes and a side surface of the first buffer block; on the other aspect, the at least one buffer block disposed between the first electrodes and the first base substrate can also buffer external force that cause curving. Therefore, upon the antenna structure being curved or bent, the antenna structure can prevent the first electrodes from breaking or falling off from the first base substrate by at least one first buffer block disposed between the first electrodes and the first substrate, so that the antenna structure can be suitable for a flexible electronic device such as a wearable smart device. And because of the at least one first buffer block disposed between the first electrodes and the first base substrate, a relative position of the first electrodes and the first base substrate does not change due to a breakage or abscission problem, and a regulation precision can also be improved upon the first electrodes controlling the dielectric layer, so as to improve an accuracy of the antenna structure for an electromagnetic wave.

For example, in the antenna structure provided by an example of the present embodiment, as illustrated in FIG. 1, the antenna structure includes a plurality of first buffer blocks 117.

For example, in the antenna structure provided by an example of the present embodiment, as illustrated in FIG. 1, the antenna structure further includes a second electrodes 125 disposed on a side of the second base substrate 120 close to the dielectric layer 130.

For example, in the antenna structure provided by an example of the present embodiment, the first electrodes include at least one curved electrode. Because the first buffer block is at least partially and directly contacted with the first electrodes, the first electrodes can be curved along with the shape of the first buffer block to form curved electrodes, the curved electrodes can further buffer the external force that cause curving of the antenna structure. For example, the curved electrodes can generate elastic deformation in a direction parallel to the first base substrate so as to have a better buffering effect on the external force parallel to the first base substrate.

For example, as illustrated in FIG. 1, the shape of the curved electrodes can include at least one wave peak structure.

For example, as illustrated in FIG. 1, the shape of the curved electrodes can be a square wave. Certainly, the present disclosure includes but is not limited thereto, the shape of the curved electrodes can also be a sine wave and so on.

For example, in the antenna structure provided by an example of the present embodiment, the dielectric layer can include liquid crystals. Therefore, an orientation of the liquid crystals between the first electrodes and the second electrodes can be adjusted by changing the voltage applied to the first electrodes so as to adjust the resonant frequency of the antenna structure.

For example, in the antenna structure provided by an example of the present embodiment, the first base substrate and the second base substrate can be flexible substrates. Therefore, the antenna structure can be applied to a fixable electronic device.

For example, the first base substrate and the second base substrate can be polymer substrates or metal substrates having better extensibility.

Figure 2:
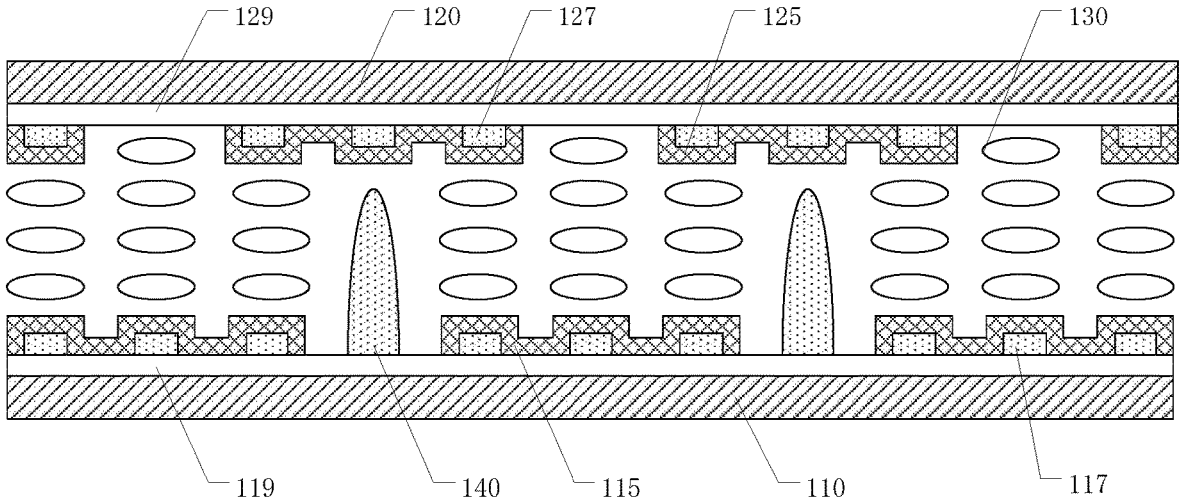
FIG. 2 a sectional view of another antenna structure provided by an embodiment of the present disclosure.

For example, FIG. 2 illustrates a sectional view of another antenna structure according to the present embodiment. As illustrated in FIG. 2, the antenna structure provided by an example of the present embodiment can further include at least one second buffer block 127 disposed between the second electrodes 125 and the second base substrate 120, the second buffer block 127 is at least partially and directly contacted with the second electrodes 125. Similarly, compared to a case of directly disposing the second electrodes on the second base substrate, in one aspect, at least one second buffer block disposed between the second electrodes and the second base substrate can increase a contact area between the second electrodes and the second buffer block, and a contact area between the second electrodes and the second base substrate, so as to increase a bonding force between the second electrodes and the second buffer block, and a bonding force between the second electrodes and the second base substrate, and an acting force between the second electrodes and a side surface of the second buffer block; in the other aspect, at least one buffer block disposed between the second electrodes and the second base substrate can also buffer external force that cause curving. Therefore, upon the antenna structure being curved or bending, the antenna structure can prevent the second electrodes from breaking or falling off from the second base substrate by at least one second buffer block disposed between the second electrodes and the second substrate, so that the antenna structure can be suitable for a flexible electronic device such as a wearable smart device. And because of the at least one second buffer block disposed between the second electrodes and the second base substrate, a relative position of the second electrodes and the second base substrate does not change due to a breakage or abscission problem, and a regulation precision can also be improved upon the second electrodes controlling the dielectric layer, so as to improve an accuracy of the antenna structure for an electromagnetic wave.

Similarly, the second electrodes include at least one curved electrode. Because the second buffer block is at least partially and directly contacted with the second electrodes, the second electrodes can be curved along with the shape of the second buffer block to form curved electrodes, the curved electrodes can further buffer the external force that cause curving of the antenna structure. For example, the curved electrodes can generate elastic deformation in a direction parallel to the second base substrate so as to have a better buffering effect on the external force parallel to the second base substrate.

For example, in the antenna structure provided by an example of the present embodiment, as illustrated in FIG. 2, each of the first electrodes 115 is provided with at least one first buffer block 117 between the each of the first electrodes 115 and the first base substrate 110, each of the second electrodes 125 is provided with at least one second buffer block 127 between each of the second electrodes 125 and the second base substrate 120. Therefore, each of the first electrodes 115 can be curved along with the shape of the first buffer block 117 to form curved electrodes; each of the second electrodes 125 can be curved along with the shape of the second buffer block 127 to form curved electrodes. In addition, each of the first electrodes can increase the contact area among the first electrodes and at least one first buffer block correspondingly disposed and the first base substrate by the at least one first buffer block correspondingly disposed, so as to increase the bonding force among the first electrodes and the first buffer block and the first base substrate, and the acting force between the first electrodes and a side surface of the at least one first buffer block correspondingly disposed, therefore, upon the antenna structure being curved or bent, the antenna structure can prevent each of the first electrodes from breaking or falling off from the first base substrate. Similarly, each of the second electrodes can increase the contact area among the second electrodes and at least one second buffer block correspondingly disposed and the second base substrate by the at least one second buffer block correspondingly disposed, so as to increase the bonding force among the second electrodes and the second buffer block and the second base substrate, and the acting force between the second electrodes and a side surface of the at least one second buffer block correspondingly disposed, therefore, upon the antenna structure being curved or bent, the antenna structure can prevent each of the second electrodes from breaking or falling off from the second base substrate.

For example, in the antenna structure provided by an example of the present embodiment, each of the first electrodes 115 is provided with a plurality of first buffer blocks 117 which are spaced apart and disposed between the each of the first electrodes 115 and the first base substrate 110, each of the second electrodes 125 is provided with a plurality of second buffer blocks 127 which are spaced apart and disposed between the each of the second electrodes 125 and the second base substrate 120. Therefore, each of the first electrodes 115 can be curved along with the shape of the first buffer block 117 to form curved electrodes including a plurality of wave peak structures, each of the second electrodes 125 can be curved along with the shape of the second buffer block 127 to form curved electrodes including a plurality of wave peak structures, so as to increase a buffering capacity of the first electrodes and the second electrodes to the external force. As illustrated in FIG. 2, three first buffer blocks 117 spaced apart are included between each of the first electrodes 115 and the first base substrate 110, the first electrodes 115 are curved electrodes including three wave peak structures; three second buffer blocks 127 spaced apart are included between each of the second electrodes 125 and the second base substrate 120, the second electrodes 125 are curved electrodes including three wave peak structures.

For example, viscosity of a material of the first buffer block is greater than that of the first base substrate, and viscosity of a material of the second buffer block is greater than that of the second base substrate. Therefore, the first buffer block and the second buffer block can increase the bending force between the first electrodes and the first buffer block, and the bending force between the second electrodes and the second buffer block by using a material with higher viscosity, so as to further prevent the first electrodes and the second electrodes from breaking or falling off from the second base substrate upon the antenna structure being curved or bent. For example, viscosity of the material of the first buffer block and/or viscosity of the material of the second buffer block are greater than 1000 Pa·s.

For example, elasticity modulus of the material of the first buffer block is less than that of the first base substrate, and elasticity modulus of the material of the second buffer block is less than that of the second base substrate. For example, upon the first base substrate and the second substrate being glass substrates, the elasticity modulus of materials of the first buffer block and the second buffer block is less than 72000 mpa. Therefore, compared to a case of directly disposing the first electrodes on the first base substrate, the first buffer block is disposed between the first electrodes and the first base substrate, and the elasticity modulus of the first buffer block is less than that of the first base substrate, so as to increase the ability of the first buffer block to buffer the external force that cause curving. Similarly, compared to a case of directly disposing the second electrodes on the second base substrate, the second buffer block is disposed between the second electrodes and the second base substrate, and the elasticity modulus of the second buffer block is less than that of the second base substrate, so as to increase the ability of the second buffer block to buffer the external force that cause curving.

For example, the material of the first buffer block includes poly-dimethylsiloxane. Because the poly-dimethylsiloxane not only has lower elastic modulus, but also has higher viscosity, so that the bonding force between the first electrodes and the first buffer block can be increased, and the first buffer block has a better buffering effect on the external force that cause curving and bending. And, the poly-dimethylsiloxane has a Si—O bond with a relatively high bond energy, and upon the poly-dimethylsiloxane being long-term used in a temperature range of −50-+250° C., the poly-dimethylsiloxane can ensure excellent film forming ability, adhesion and elasticity, while also having good flexibility. In addition, because the poly-dimethylsiloxane is less obstructive to an electromagnetic wave, it does not affect the signal transmission of the antenna structure.

For example, the material of the second buffer block includes poly-dimethylsiloxane. Because the poly-dimethylsiloxane not only has lower elastic modulus, but also has higher viscosity, so that the bonding force between the second electrodes and the second buffer block can be increased, and the second buffer block has a better buffering effect on the external force that cause curving and bending. In addition, because the poly-dimethylsiloxane is less obstructive to an electromagnetic wave, it does not affect the signal transmission of the antenna structure.

For example, in the antenna structure provided by an example of the present embodiment, as illustrated in FIG. 2, the antenna structure further includes a first control electrode 119 disposed between the first base substrate 110 and the first buffer block 117, and the first control electrode 119 is electrically connected with the first electrodes 115, so that the first electrodes 115 can be applied electrical signals through the first control electrode 119. Certainly, embodiments of the present disclosure include but are not limited thereto, each of the first electrodes can be electrically connected with a wire, so that the first electrodes can be applied electrical signals through the wires.

For example, in the antenna structure provided by an example of the present embodiment, as illustrated in FIG. 2, the antenna structure further includes a second control electrode 129 disposed between the second base substrate 120 and the second buffer block 127, and the second control electrode 129 is electrically connected with the second electrodes 125, so that the second electrodes 125 can be applied electrical signals through the second control electrode 129. Certainly, embodiments of the present disclosure include but are not limited thereto, each of the second electrodes can be electrically connected with a wire, so that the second electrodes can be applied electrical signals through the wires.

For example, the material of the first control electrode can be selected from at least one of indium tin oxide, graphene, and carbon nanotubes. And the material of the second control electrode can be selected from at least one of indium tin oxide, graphene, and carbon nanotubes.

For example, in the antenna structure provided by an example of the present embodiment, as illustrated in FIG. 2, the first control electrode 119 is disposed on the entire first substrate 110, and the second control electrode 129 is disposed on the entire second substrate 120.

For example, in the antenna structure provided by an example of the present embodiment, as illustrated in FIG. 2, orthogonal projections of the first electrode 115 and the second electrodes 125 on the first base substrate 110 are disposed alternately. That is, each of the second electrodes is disposed on an area between two adjacent ones of the first electrodes. Therefore, an area on the second base substrate corresponding to each of the first electrodes can be as a feed hole, which is used to infeed the electromagnetic wave. Similarly, an area on the first base substrate corresponding to each of the second electrodes can be as an infeed hole, which is used to infeed the electromagnetic wave.

For example, in the antenna structure provided by an example of the present embodiment, the orthogonal projections of the first electrode and the second electrodes on the first base substrate are at least partially overlapped and alternately disposed. The orthogonal projections of the first electrode and the second electrodes on the first base substrate are at least partially overlapped and alternately disposed, so as to form an electric field to adjust an orientation of the liquid crystals between the first electrodes and the second electrodes, so that the resonant frequency of the antenna structure can be adjusted. For example, the first electrodes are metal electrodes, and the second electrodes are metal electrodes.

For example, in the antenna structure provided by an example of the present embodiment, as illustrated in FIG. 2, the antenna structure further includes a retaining wall 140 disposed on a side of the first base substrate 110 close to the second base substrate 120, and extending towards the second base substrate 120. The retaining wall 140 is located in an area between adjacent ones of the first electrodes 115. Therefore, upon the antenna structure being curved or bent, the retaining wall can prevent the liquid crystals from flowing, so as to avoid a case that the thickness of the liquid crystals in different positions of the antenna structure is inequality. It should be noted that, the liquid crystals between the two adjacent retaining walls, the first electrodes and the second electrodes can constitute a resonant cavity. In addition, a retaining wall can also be disposed on a side of the second base substrate close to the first base substrate, and extending towards the first base substrate, and is located in an area between adjacent ones of the second electrodes.

For example, the material of the retaining wall is the same as that of the first buffer block.

Figure 3:
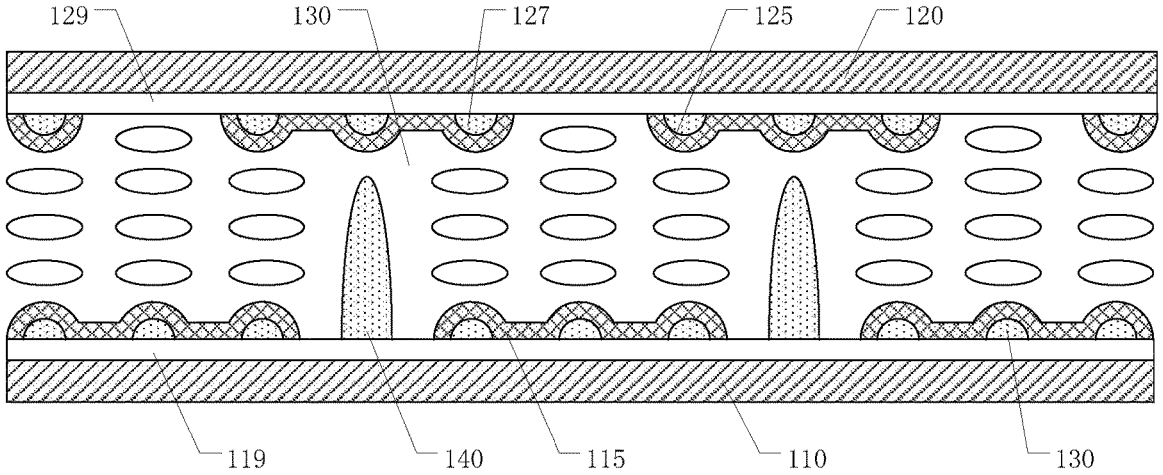
FIG. 3 is a sectional view of another antenna structure provided by an embodiment of the present disclosure.

For example, in the antenna structure provided by an example of the present embodiment, as illustrated in FIG. 2, a cross-sectional shape of the first buffer block 117 and the second buffer block 127 is a rectangular shape. Certainly, the cross-sectional shape of the first buffer block and the second buffer block is not limited to the rectangular shape. For example, FIG. 3 illustrates a sectional view of another antenna structure according to the present embodiment. As illustrated in FIG. 3, the cross-sectional shape of the first buffer block 117 and the second buffer block 127 is semi-circular. Of cause, embodiments of the present disclosure include but are not limited thereto, the cross-sectional shape of the first buffer block and the second buffer block can be a trapezoidal shape or other shapes.

Figure 4:
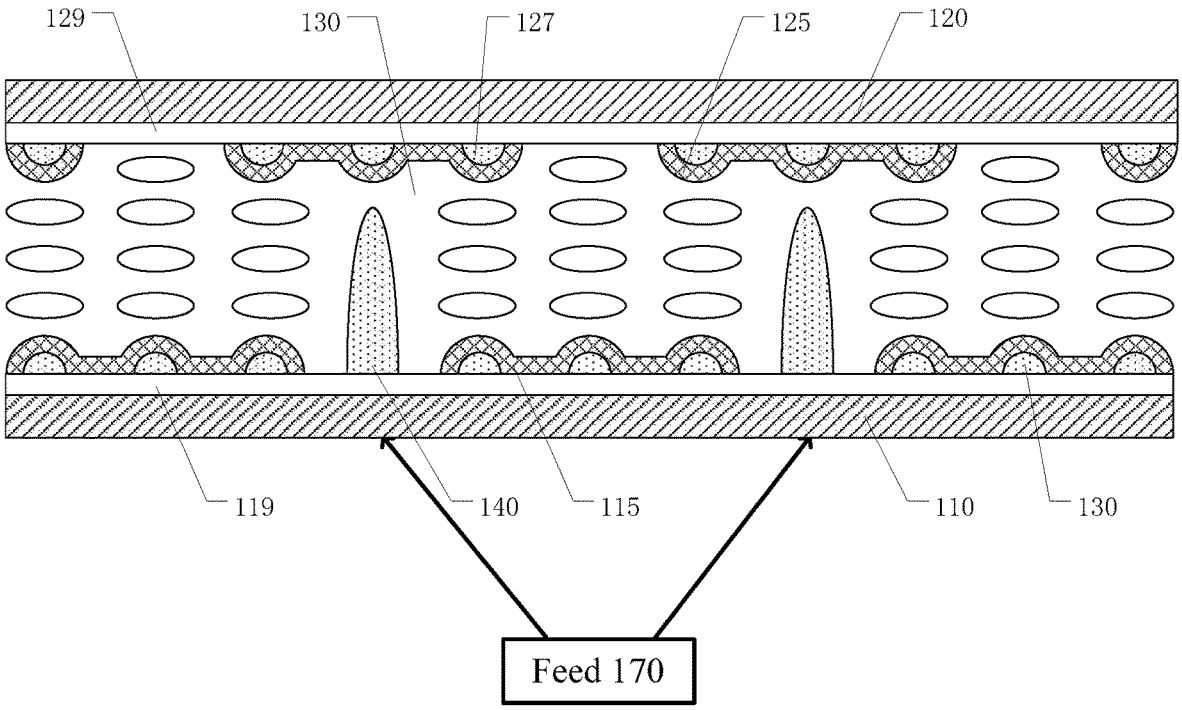
FIG. 4 is a sectional view of another structure provided by an embodiment of the present disclosure.

For example, FIG. 4 illustrates a sectional view of another antenna structure according to the present embodiment. As illustrated in FIG. 4, in the antenna structure provided by an example of the present embodiment, the antenna structure further includes a feed 170, disposed on a side of the first base substrate 110 away from the second base substrate 120. At this moment, an area between adjacent ones of the first electrodes 115 on the first base substrate 110 can be as a feed hole of the feed 170.

For example, the material of the retaining wall can also include poly-dimethylsiloxane. Because the poly-dimethylsiloxane is less obstructive to an electromagnetic wave, it does not affect the signal transmission of the antenna structure.

Figure 5:
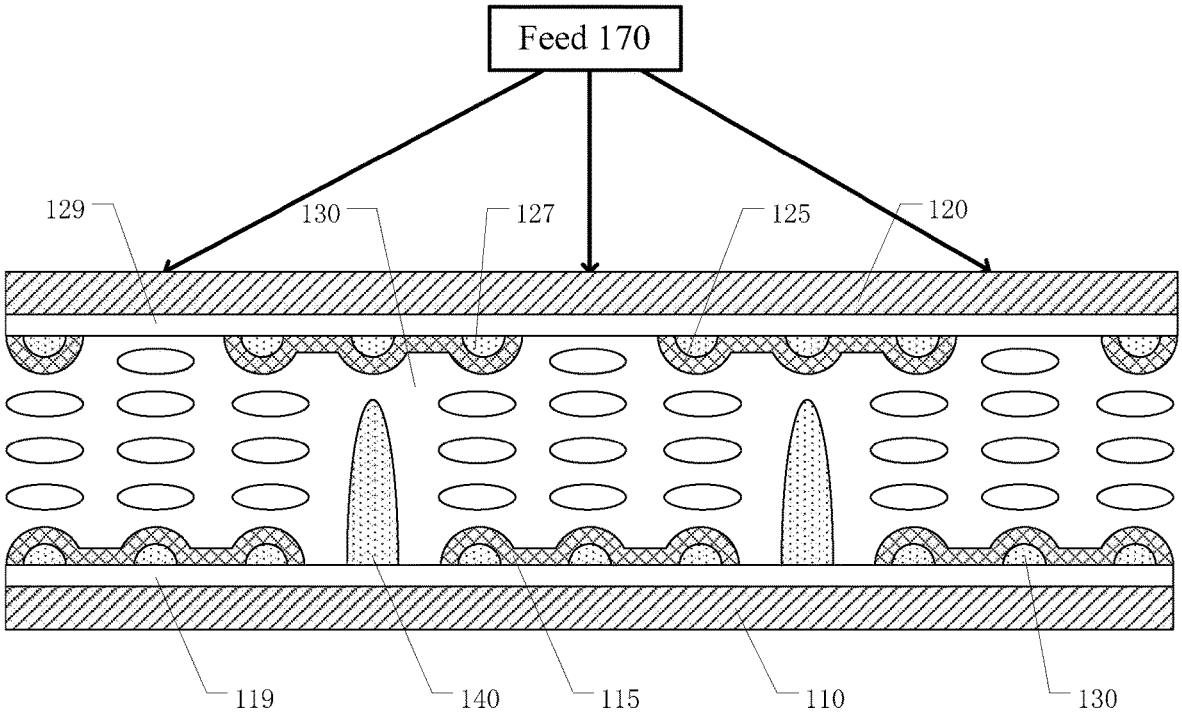
FIG. 5 is a sectional view of another structure provided by an embodiment of the present disclosure.

For example, FIG. 5 illustrates a sectional view of another antenna structure according to the present embodiment. As illustrated in FIG. 5, in the antenna structure provided by an example of the present embodiment, the antenna structure further includes a feed 170, disposed on a side of the second base substrate 120 away from the first base substrate 110. At this moment, an area between adjacent ones of the second electrodes 125 on the second base substrate 120 can be as a feed hole of the feed 170.

It should be noted that, the abovementioned antenna structure can be manufactured using a thin film transistor liquid crystal display device production line. For example, the first electrodes and the second electrodes can be formed on the first base substrate and the second base substrate respectively by processes such as deposition or evaporation and a patterning process. In addition, the first buffer block and the second buffer block can be formed by a patterning process or transfer printing process.

An embodiment of the present disclosure further provides a communication device, which includes the antenna structure described by any example of the abovementioned embodiment. Therefore, the communication device has technical effects corresponding to the technical effects of the antenna structure included in the communication device, and can refer the relevant description in the abovementioned embodiment, embodiments of the present disclosure are not repeated herein.

For example, the communication device can be a flexible wearable device. Because the communication device adopts the antenna structure in the abovementioned embodiments, upon the communication device being curved or bent, the communication device can prevent the first electrodes from breaking or falling off from the first base substrate, and the communication device can also prevent the second electrodes from breaking or falling off from the second base substrate, and can also improve communication quality and effect upon the communication device being curved or bent. Certainly, the communication provided by the present embodiment can also be an electronic device other than the flexible wearable device.

Figure 6:
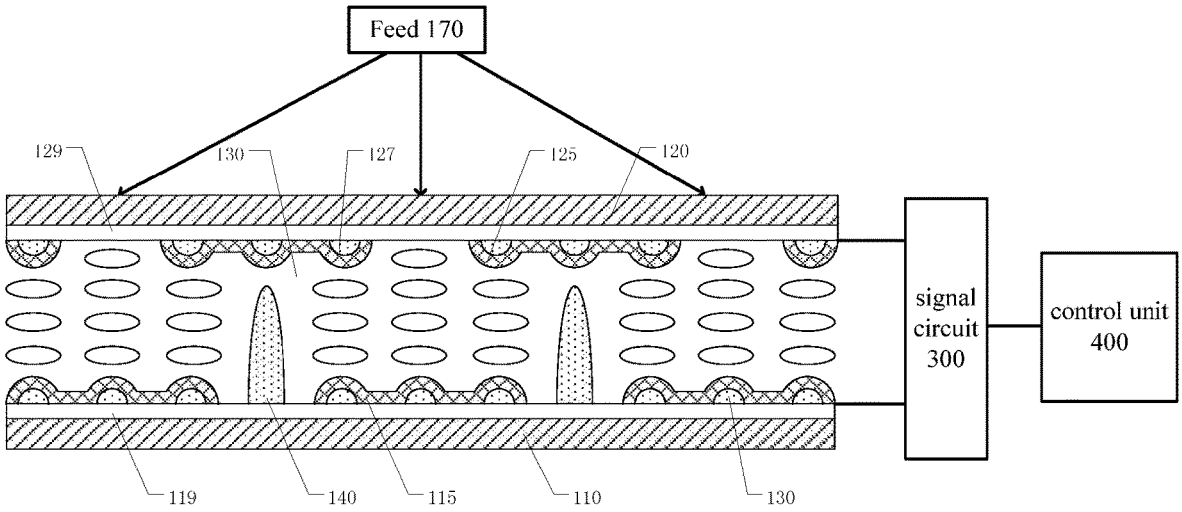
FIG. 6 is a schematic diagram of a communication device provided by an embodiment of the present disclosure.

For example, FIG. 6 illustrates a communication device provided by an embodiment of the present disclosure. As illustrated in FIG. 6, the communication device further includes a signal circuit 300 and a control unit 400, the signal circuit 300 is electrically connected with the antenna structure 100, and the control unit 400 is electrically connected with the signal circuit 300. Therefore, the control unit 400 is electrically connected with the antenna structure through the signal circuit 300 so as to control the antenna structure.

An embodiment of the present disclosure provides a manufacturing method of an antenna structure. The manufacturing method includes: providing a first base substrate and a second base substrate; forming at least one first buffer block on the first base substrate, for example, the first buffer block can be formed by evaporation and a patterning process; forming a plurality of first electrodes spaced apart on the first base substrate formed with the first buffer block, for example, the first electrodes can be formed by deposition and a patterning process; and cell assembling the first base substrate and the second base substrate, and injecting dielectric materials between the first base substrate and the second base substrate to form a dielectric layer.

For example, the manufacturing method of the antenna structure provided by an example of, the present embodiment further includes: forming a plurality of second electrodes on the second base substrate, for example, the second electrodes can be formed by deposition and a patterning process.

For example, in the manufacturing method of the antenna structure provided by an example of the present embodiment, before forming the at least one first buffer block on the first base substrate, a control electrode can also be formed on the first base substrate.

For example, in the manufacturing method of the antenna structure provided by an example of the present embodiment, before forming the second electrodes on the second base substrate, at least one second buffer block can be formed on the second base substrate.

For example, in the manufacturing method of the antenna structure provided by an example of the present embodiment, before forming the at least one second buffer block on the second base substrate, a second control electrode can be formed on the second base substrate.

The following points should to be explained:

1) The drawings of at least one embodiment of the present disclosure only relate to the structure in the embodiment of the present disclosure, and other structures may be referenced to the usual design.

2) In the absence of conflict, the features of the same embodiment and the different embodiments ban be combined with each other.

The above are only specific implementations of the present disclosure, however the scope of the present disclosure is not limited thereto, variations or substitutions that easily occur to any one skilled in the art within the technical scope disclosed in the present disclosure should be encompassed in the scope of the present disclosure. Therefore, the scope of the present disclosure should be based on the scope of the claims.

What is claimed is:

1. An antenna structure, comprising:

a first base substrate;

a second base substrate;

a dielectric layer, disposed between the first base substrate and the second base substrate;

a plurality of first electrodes, disposed on a side of the first base substrate close to the dielectric layer and being spaced apart from one another; and at least one first buffer block, disposed between the first electrodes and the first base substrate, wherein the first buffer block is at least partially and directly contacted with the first electrodes in a direction perpendicular to the first base substrate, wherein the first buffer block is at least partially and directly contacted with the first electrodes, an orthographic projection of the at least one first buffer block on the first base substrate falls within an orthographic projection of the first electrodes on the first base substrate.

2. The antenna structure according to claim 1, further comprising: a plurality of second electrodes, disposed on a side of the second base substrate close to the dielectric layer.

3. The antenna structure according to claim 2, further comprising:

at least one second buffer block, disposed between the second electrodes and the second base substrate, wherein the second buffer block is at least partially and directly contacted with the second electrodes.

4. The antenna structure according to claim 3, wherein each of the first electrodes is provided with at least one first buffer block disposed between the each of the first electrodes and the first base substrate, and each of the second electrodes is provided with at least one second buffer block disposed the each of the second electrodes and the second base substrate.

5. The antenna structure according to claim 4, wherein each of the first electrodes is provided with a plurality of first buffer blocks which are spaced apart and disposed between the each of the first electrodes and the first base substrate, and each of the second electrodes is provided with a plurality of second buffer blocks which are spaced apart and disposed between the each of the second electrodes and the second base substrate.

6. The antenna structure according to claim 3, wherein a cross-sectional shape of the first buffer block and/or the second buffer block comprises at least one selected from the group consisting of a rectangular shape, a semicircular shape and a trapezoidal shape.

7. The antenna structure according to claim 3, wherein viscosity of a material of the first buffer block is greater than that of the first base substrate, and viscosity of a material of the second buffer block is greater than that of the second base substrate.

8. The antenna structure according to claim 3, wherein elasticity modulus of a material of the first buffer block is less than that of the first base substrate, and elasticity modulus of a material of the second buffer block is less than that of the second base substrate.

9. The antenna structure according to claim 3, wherein viscosity of a material of the first buffer block and/or viscosity of a material of the second buffer block are greater than 1000 Pa·s.

10. The antenna structure according to claim 3, wherein a material of the first buffer block and/or a material of the second buffer block comprise poly-dimethylsiloxane.

11. The antenna structure according to claim 3, further comprising:

a first control electrode, disposed between the first base substrate and the first buffer block, and electrically connected with the first electrodes; and a second control electrode, disposed between the second base substrate and the second buffer block, and electrically connected with the second electrodes.

12. The antenna structure according to claim 3, wherein orthogonal projections of the first electrodes and the second electrodes on the first base substrate are disposed alternately.

13. The antenna structure according to claim 12, wherein the orthogonal projections of the first electrode and the second electrodes on the first base substrate are at least partially overlapped and alternately disposed.

14. The antenna structure according to claim 2, wherein the first electrodes and/or the second electrodes comprise at least one curved electrode.

15. The antenna structure according to claim 2, further comprising:

a retaining wall, wherein the retaining wall is disposed on a side of the second base substrate close to the first base substrate, extending towards the first base substrate, and located in an area between adjacent ones of the first electrodes; or the retaining wall is disposed on a side of the first base substrate close to the second base substrate, and extending towards the second base substrate, and located in an area between adjacent ones of the second electrodes.

16. The antenna structure according to claim 15, wherein the first buffer block and the retaining wall comprise a same material.

17. The antenna structure according to claim 1, wherein the dielectric layer comprises liquid crystals.

18. A communication device, comprising the antenna structure according to claim 1.

19. The communication device according to claim 18, further comprising a signal circuit and a control unit, the signal circuit is electrically connected with the antenna structure, the control unit is electrically connected with the signal circuit.

* * * * *